US010940715B2

(12) United States Patent
Moalli

(10) Patent No.: US 10,940,715 B2
(45) Date of Patent: Mar. 9, 2021

(54) METHOD FOR FORMING DYE SUBLIMATION IMAGES IN AND TEXTURING OF SOLID SUBSTRATES

(71) Applicant: Fresco Infusion LLC, Friday Harbor, WA (US)

(72) Inventor: John Moalli, Friday Harbor, WA (US)

(73) Assignee: Fresco Infusion LLC, Friday Harbor, WA (US)

( * ) Notice: Subject to any disclaimer, the term of this patent is extended or adjusted under 35 U.S.C. 154(b) by 0 days.

(21) Appl. No.: 16/925,182

(22) Filed: Jul. 9, 2020

(65) Prior Publication Data

US 2020/0346483 A1 Nov. 5, 2020

Related U.S. Application Data

(63) Continuation-in-part of application No. 16/743,979, filed on Jan. 15, 2020, which is a continuation of (Continued)

(51) Int. Cl.
*B44C 1/00* (2006.01)
*B44C 1/17* (2006.01)

(Continued)

(52) U.S. Cl.
CPC ..... *B44C 1/1712* (2013.01); *B41M 5/0064* (2013.01); *B41M 5/0358* (2013.01)

(58) Field of Classification Search
CPC .... B44C 1/1712; B44C 1/1733; B41M 5/035; B41M 5/0358; B41M 1/30; B41M 7/009; B41M 5/382; D06P 5/004

(Continued)

(56) References Cited

U.S. PATENT DOCUMENTS 4,465,728 A 8/1984 Haigh
5,580,410 A * 12/1996 Johnston ..... B41M 5/0358 156/240

(Continued)

FOREIGN PATENT DOCUMENTS

GB 1598836 9/1981
JP S51-148752 12/1976

(Continued)

OTHER PUBLICATIONS

Office Action from U.S. Appl. No. 16/163,840 dated Sep. 18, 2019.

(Continued)

*Primary Examiner* — Eisa B Elhilo
(74) *Attorney, Agent, or Firm* — Beyer Law Group LLP

(57) ABSTRACT

A method for texturing a thermoplastic substrate, while forming a dye sublimation image in the thermoplastic substrate is provided. A stack comprising a thermoplastic substrate and a plurality of processing layers is provided, wherein the plurality of processing layers comprise a dye carrier having a dye image and an elastomeric membrane and wherein at least one of the processing layers of the stack is textured. A vacuum pressure is provided on the stack through an elastomeric membrane, wherein the stack is clamped together. The stack is heated to at least a sublimation temperature of the stack, wherein texture from at least one of the process layers is transferred to the thermoplastic substrate. The thermoplastic substrate is cooled to a release temperature. The vacuum pressure is removed. The thermoplastic substrate is removed from the stack.

20 Claims, 11 Drawing Sheets

Related U.S. Application Data application No. 16/163,840, filed on Oct. 18, 2018, now Pat. No. 10,583,686.

(51) Int. Cl.
*B41M 5/035* (2006.01)
*B41M 5/00* (2006.01)

(58) Field of Classification Search
USPC ..... 8/471; 156/230, 238
See application file for complete search history.

(56) References Cited

U.S. PATENT DOCUMENTS

| | | | | |
|---|---|---|---|---|
| 6,508,171 | B1 | 1/2003 | Georges | |
| 6,814,831 | B2 * | 11/2004 | Drake | B41M 5/0256 156/230 |
| 6,998,005 | B2 * | 2/2006 | Magee | B41M 5/0256 156/230 |
| 7,810,538 | B2 * | 10/2010 | Magee | D06P 5/004 156/498 |
| 8,308,891 | B2 * | 11/2012 | Drake | B41M 5/0064 156/289 |
| 8,562,777 | B2 * | 10/2013 | Drake | D06P 5/004 156/230 |
| 10,583,686 | B1 | 3/2020 | Moalli | |
| 2006/0017942 | A1 | 1/2006 | Clark | |
| 2013/0244045 | A1 | 9/2013 | Song et al. | |

FOREIGN PATENT DOCUMENTS

| | | |
|---|---|---|
| JP | S54-87755 | 7/1979 |
| TW | 201208860 | 3/2012 |
| WO | 01/177454 | 3/2001 |

OTHER PUBLICATIONS

John Moalli, U.S. Appl. No. 16/743,979, filed Jan. 15, 2020.
European Search Report from European Application No. 19202460 dated Mar. 24, 2020.
Japanese Office Action from Japanese Application No. 2019-189061 dated Mar. 18, 2020.
Office Action from U.S. Appl. No. 16/743,979 dated Sep. 29, 2020.
Japanese Office Action from Japanese Application No. 2019-189061 dated Oct. 6, 2020.

* cited by examiner

METHOD FOR FORMING DYE SUBLIMATION IMAGES IN AND TEXTURING OF SOLID SUBSTRATES

CROSS-REFERENCE TO RELATED APPLICATION

This application is a Continuation-in-Part of and claims the benefit of priority of U.S. application Ser. No. 16,743,979 filed Jan. 15, 2020, which is a Continuation Application of and claims the benefit of priority of U.S. application Ser. No. 16/163,840, filed Oct. 18, 2018, which are incorporated herein by reference for all purposes.

BACKGROUND

The present invention relates to the formation of images within solid sheets of a substrate and texturing the surface of the solid sheets of the substrate.

From the advent of plastics, users and manufacturers have sought a workable method for imprinting or forming images thereon. Prior imaging technologies suitable for use on other materials, for instance, metals, wood, and the like, have not generally met with success when used to perform permanent imaging on plastics. Examples of such prior imaging technologies include, but are not limited to, paints, decals, lacquers, and dyes. In general, the problems associated with utilizing prior imaging or marking technologies center on certain chemical and physical properties of plastics in general.

One of the great advantages of plastics is that they can be formed into complex shapes having inherently very smooth surfaces. While this is an advantage in the manufacture of such plastic objects, the extremely smooth and often chemically resistant nature of plastic surfaces renders the application thereto of paints and the like less than satisfactory. Many paints, for instance, enamels, when applied to plastics, tend to flake or peel when the plastic is flexed or when the image is subjected to physical distress, such as abrasion or temperature change.

In searching for a methodology for forming permanent, abrasion-resistant images in sheet plastics, workers in this field have noted that plastics tend to be molecularly similar to certain fabrics, which are imaged utilizing a dying process known as "dye sublimation." According to known dye sublimation processes, an image, for instance, a decorative design, is formed of sublimation printing inks on a dye carrier, sometimes also referred to as a transfer paper or auxiliary carrier or sheet.

Sheets are often, but not exclusively, formed of paper. Printing the image on the sheet is carried out by any of several known printing methods including, but specifically not limited to, offset, inkjet, or rotary printing methods. The print images formed on the sheet are transferred by sublimation, also called transfer printing, from the dye carrier to the textile or fabric, which is to be decorated with the design.

There are several known dyestuffs suitable for use with dye sublimation printing techniques. The actual dye sublimation ink utilized is not essential to the principles of the present invention, provided that the dyestuff is capable of sublimation. This is to say that the dye sublimation ink moves directly to the vapor state from the solid state upon the application of heat. One type of printing ink suitable for sublimation printing is prepared from dye sublimation ink utilizing binders and oxidation additives. The term "sublimable" is defined herein to mean capable of sublimation.

From the foregoing discussion, it will be appreciated that one of the advantages of dye sublimation printing is that the image is formed within the structure of the textile, or substrate, on which it is imprinted. This is in direct contrast to most printing techniques, wherein the image is formed solely on the surface of the substrate. While surface-formed images are completely suitable for many applications, they are less than optimal for others. By way of illustration, in the preceding discussion of dye sublimation images formed in textiles, it will be appreciated that if a textile is subjected to substantial wear, as is a carpet, an image formed solely on the surface of that carpet, or on the surface of the individual carpet fibers, will tend to wear quickly.

It will further be appreciated that most inks suitable for forming surface images tend to be opaque. Again, this is suitable for many applications. However, where it is desirous that the resultant article has a lustrous or translucent property, the use of such opaque inks precludes the desired translucent image.

U.S. Pat. No. 8,308,891, issued Nov. 13, 2012, entitled "Method For Forming Dye Sublimation Images In Solid Substrates" describes a method for forming dye sublimation images in a plastic substrate and is incorporated by reference for all purposes.

SUMMARY

To achieve the foregoing and in accordance with the purpose of the present disclosure, a method for texturing a thermoplastic substrate, while forming a dye sublimation image in the thermoplastic substrate is provided. A stack comprising a thermoplastic substrate and a plurality of processing layers is provided, wherein the plurality of processing layers comprise a dye carrier having a dye image formed thereon and an elastomeric membrane and wherein at least one of the processing layers of the stack is textured. A vacuum pressure is provided on the stack through an elastomeric membrane, wherein the stack is clamped together. The stack is heated to at least a sublimation temperature of the stack, which causes the dye sublimation ink to sublimate and penetrate through a side of the thermoplastic substrate, creating a dye sublimation image in the thermoplastic substrate and wherein texture from at least one of the process layers is transferred to the thermoplastic substrate. The thermoplastic substrate is cooled to a release temperature, which causes the thermoplastic substrate to be substantially rigid. The vacuum pressure is removed after the thermoplastic substrate is cooled to the release temperature. The thermoplastic substrate is removed from the stack.

In another manifestation, a method for texturing a plastic substrate, while forming a dye sublimation image in the plastic substrate is provided. A textured dye carrier having an image formed thereon of a dye sublimation ink is placed on a side of the plastic substrate to form a stack. A clamping pressure is provided on the stack, wherein the stack is clamped together. The stack is heated to at least a sublimation temperature of the stack, which causes the dye sublimation ink to sublimate and penetrate through the side of the plastic substrate, creating a dye sublimation image in the plastic substrate and wherein texture from the textured dye carrier is transferred to the plastic substrate. The thermoplastic substrate is cooled to a release temperature, which causes the thermoplastic substrate to be substantially rigid. The clamping pressure is removed after the thermoplastic substrate is cooled to the release temperature. The thermoplastic substrate is removed from the stack.

These and other features of the present disclosure will be described in more detail below in the detailed description of the disclosure and in conjunction with the following figures.

BRIEF DESCRIPTION OF THE DRAWINGS

The present disclosure is illustrated by way of example, and not by way of limitation, in the figures of the accompanying drawings and in which like reference numerals refer to similar elements and in which.

DETAILED DESCRIPTION OF THE PREFERRED EMBODIMENTS

The present disclosure will now be described in detail with reference to a few preferred embodiments thereof as illustrated in the accompanying drawings. In the following description, numerous specific details are set forth in order to provide a thorough understanding of the present disclosure. It will be apparent, however, to one skilled in the art, that the present disclosure may be practiced without some or all of these specific details. In other instances, well known process steps and/or structures have not been described in detail in order to not unnecessarily obscure the present disclosure.

While the succeeding discussion is directed to the dye sublimation imaging of plastic sheets and the like, these principles may advantageously be applied to the dye sublimation imaging of a wide variety of man-made and naturally occurring sheet material substrates, including but specifically not limited to metals, stone, wood, waxes, polymers, monomers, resins, textiles, fabrics, glasses, minerals, leather, and composites thereof. These principles specifically contemplate all such applications.

Figure 1:
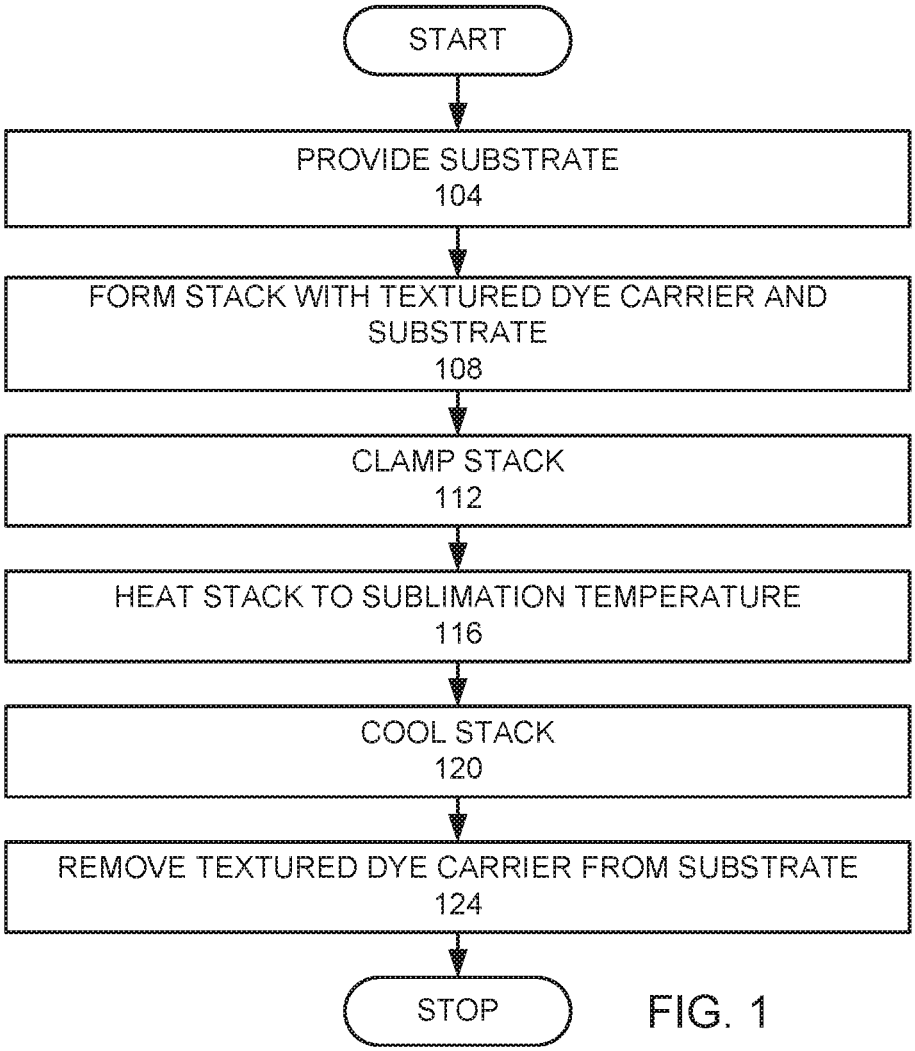
FIG. 1 is a high level flow chart of an embodiment.

To facilitate understanding, FIG. 1 is a high level flow chart of a process used in an embodiment. In this embodiment, a substrate is provided (step 104). A textured dye carrier is placed on a side of the substrate to form a stack (step 108). The stack is clamped together (step 112). The stack is heated to at least a sublimation temperature of the stack (step 116). In the specification and claims, the sublimation temperature of a stack is defined as the minimum temperature at which a solid dye on the dye carrier transitions from solid to gas phase, without passing through an intermediate liquid phase, and wherein the dye in gas phase penetrates into the substrate, where the dye creates an image in the substrate. Texture is transferred from the textured dye carrier to the substrate. The stack is cooled to a release temperature below the sublimation temperature (step 120). The textured dye carrier is removed from the substrate (step 124).

EXAMPLE

Figure 2A:
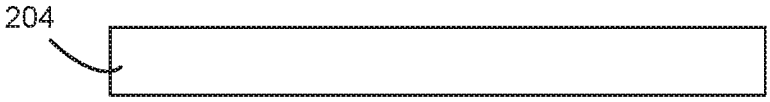
FIGS. 2A-C are schematic cross-sectional views of a stack used in an embodiment.
Figure 3:
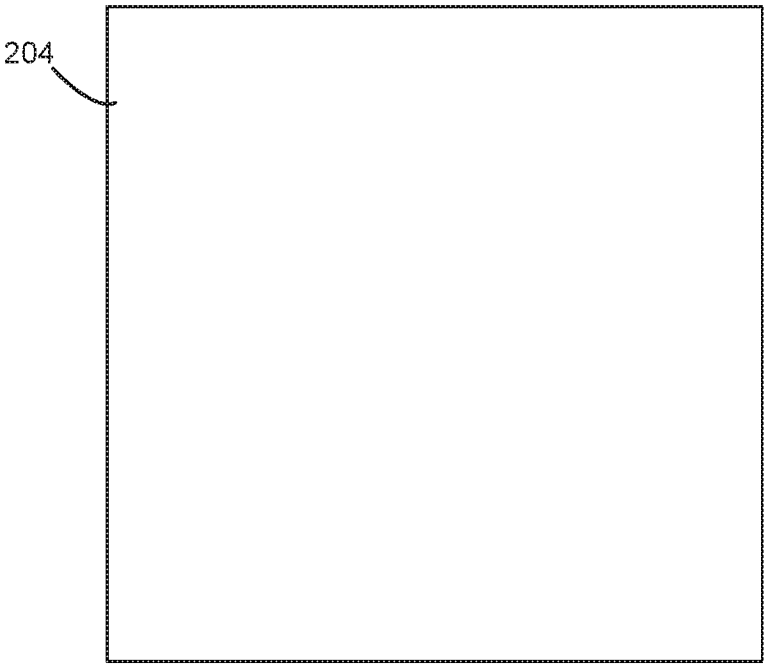
FIG. 3 is a schematic top view of a substrate used in an embodiment.
Figure 2B:
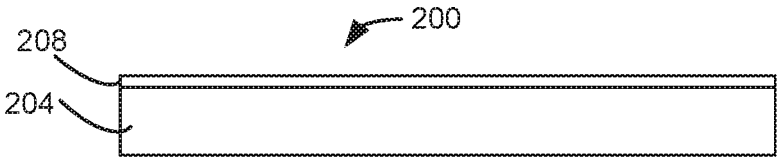
Figure 4:
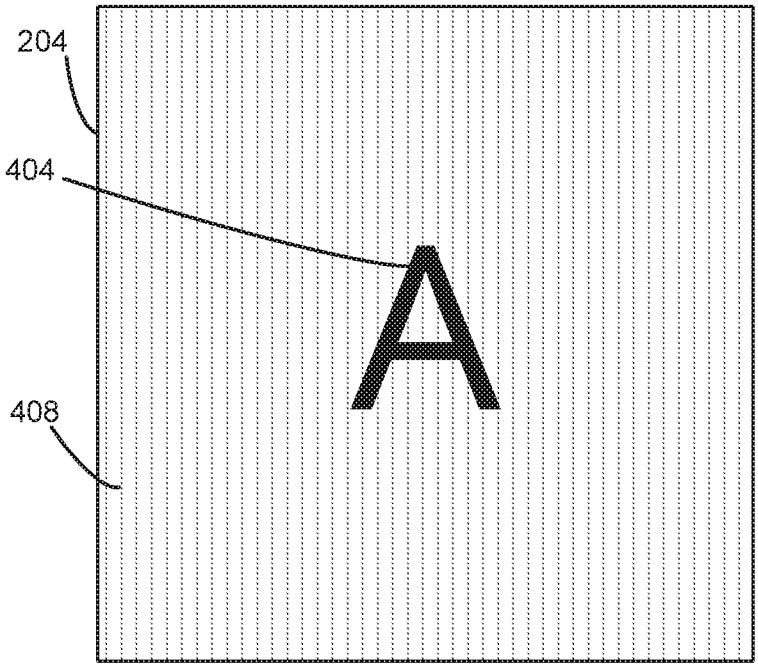
FIG. 4 is a schematic top view of a textured dye carrier used in an embodiment.

In an example of an embodiment, a stack substrate is provided (step 104). FIG. 2A is a side view of a substrate 204. FIG. 3 is a top view of the substrate 204. In this example, the substrate 204 is a thermoplastic such as acrylonitrile butadiene styrene (ABS). A textured dye carrier is placed on a side of the substrate to form a stack (step 108). FIG. 2B is a side view of a stack 200 comprising a textured dye carrier 208 placed on one side of the substrate 204. FIG. 4 is a top view of the textured dye carrier 208. The textured dye carrier 208 and the substrate 204 are not drawn to scale. Dye sublimation ink 404 is on the textured dye carrier 208 creating a design. In this example, the textured dye carrier 208 has the texture of a plurality of vertical ridges 408 on a first side of the textured dye carrier 208. The textured dye carrier 208 is placed so that the first side of the textured dye carrier 208 is against the substrate 204 so that the plurality of vertical ridges 408 is against the substrate 204.

Figure 2C:
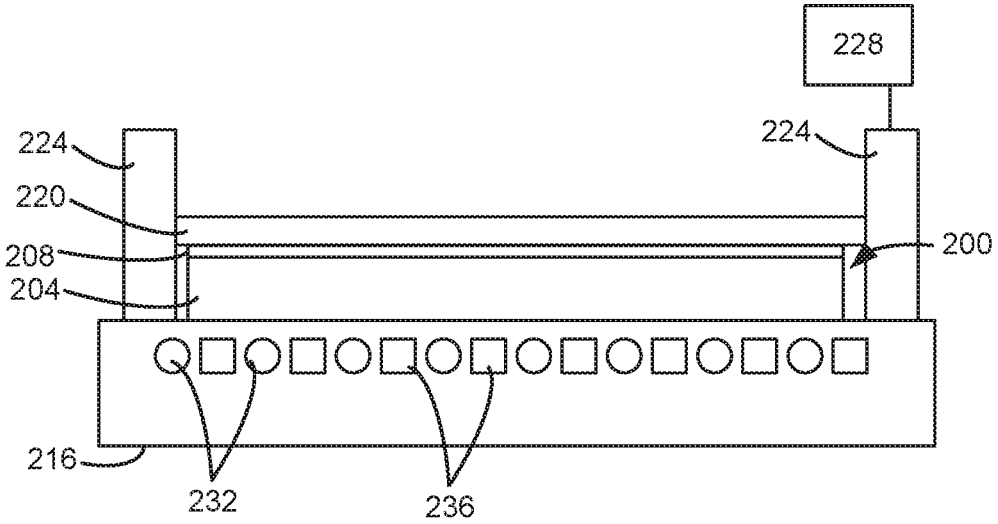

A continuous clamping pressure is provided to clamp the stack 200 (step 112). FIG. 2C is a side view of the stack 200 being clamped by a platen 216 on the bottom and a top pressure plate 220 providing a continuous clamping pressure across the stack 200. In this example, a clamping drive 224 is connected between the top pressure plate 220 and the platen 216. The clamping drive 224 provides the continuous clamping force between the top pressure plate 220 and the platen 216. A controller 228 is controllably connected to the clamping drive 224. In this example, a pressure of at least 5 pounds per square inch is provided across the entire top surface of the stack 200. In various embodiments, even if pressure is applied uniformly, the geometry of the textured dye carrier 208 may cause pressure applied to the and substrate 204 to vary on a local level.

The stack 200 is heated to at least a sublimation temperature (step 116). In this embodiment, heating elements 232 in the platen 216 are used to heat the stack 200. In this example, the sublimation temperature, which sublimates the dye and causes the dye in gas phase to penetrate into the substrate 204 and create an image in the substrate 204, is a temperature above the glass transition temperature of the substrate 204. The glass transition temperature is a temperature for which the substrate 204 transitions from a solid state to a viscous or rubbery state as temperature is increased. In this example, the stack 200 is heated to a temperature of greater than 250° F. The stack 200 is maintained at a temperature of greater than 350° F., while continuously clamped at a pressure of at least 5 pounds per square inch for at least 10 minutes.

The stack 200 is cooled to a release temperature below the sublimation temperature (step 116). In this embodiment, cooling elements 236 in the platen 216 are used to cool the stack 200. In this example, the stack 200 is cooled to a temperature below the glass transition temperature of the substrate 204. In this example, the stack 200 is cooled to a release temperature of less than 250° F. The stack 200 is maintained at a temperature of less than 250° F., while continuously clamped at a pressure of at least 5 pounds per square inch for at least 5 minutes. In this example, at the release temperature, the substrate 204 is substantially rigid.

Figure 5:
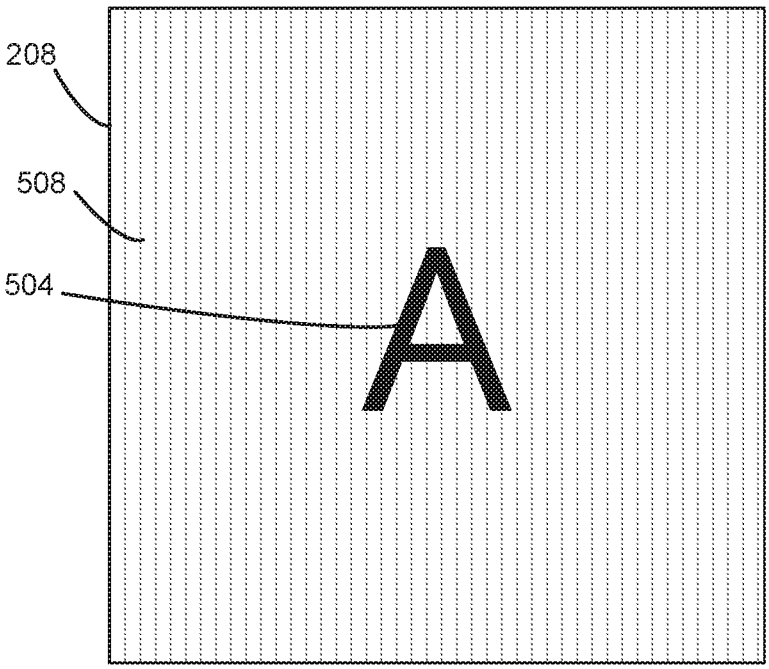
FIG. 5 is a schematic top view of a substrate processed in an embodiment

The textured dye carrier 208 is removed from the substrate 204 (step 124). In this example, the continuous clamping pressure is removed. The stack 200 is removed from the platen 216 and top pressure plate 220. The textured dye carrier 208 is removed from the substrate 204. FIG. 5 is a top view of the substrate 204. An image 504 has been sublimated into the substrate 204 from the textured dye carrier 208. The sublimated dye forms an image in the substrate 204 instead of on a surface of the substrate 204. Surface texturing 508 has been transferred to the substrate 204 from the textured dye carrier 208.

Figure 6:
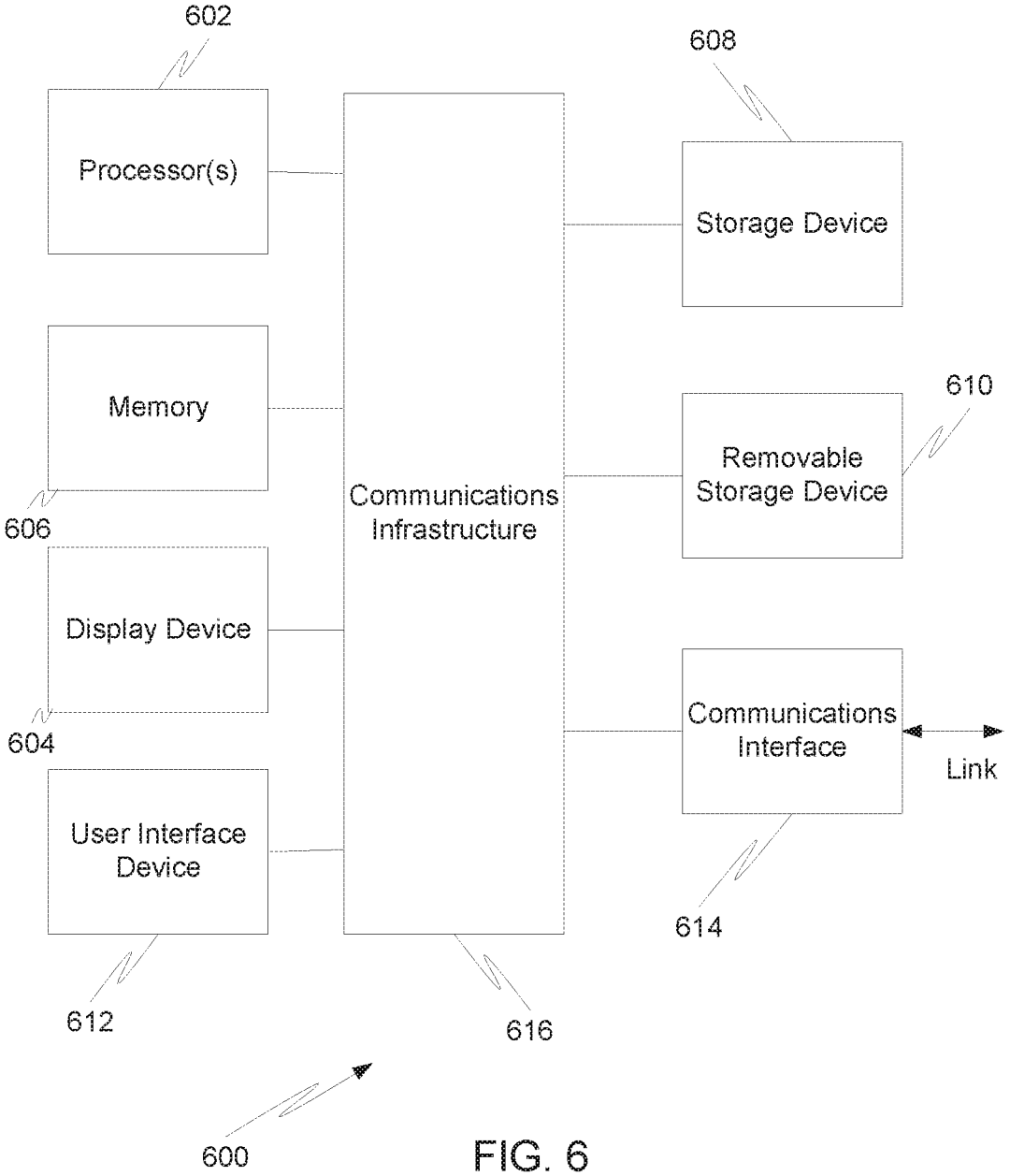
FIG. 6 is a computer system that may be used in an embodiment.

FIG. 6 is a high level block diagram showing a computer system 600, which is suitable for implementing a controller 228 used in embodiments. The computer system may have many physical forms ranging from an integrated circuit, a printed circuit board, and a small handheld device, up to a huge supercomputer. The computer system 600 includes one or more processors 602, and further can include an electronic display device 604 (for displaying graphics, text, and other data), a main memory 606 (e.g., random access memory (RAM)), storage device 608 (e.g., hard disk drive), removable storage device 610 (e.g., optical disk drive), user interface devices 612 (e.g., keyboards, touch screens, keypads, mice or other pointing devices, etc.), and a communication interface 614 (e.g., wireless network interface). The communication interface 614 allows software and data to be transferred between the computer system 600 and external devices via a link. The system may also include a communications infrastructure 616 (e.g., a communications bus, cross-over bar, or network) to which the aforementioned devices/modules are connected.

Information transferred via communications interface 614 may be in the form of signals such as electronic, electromagnetic, optical, or other signals capable of being received by communications interface 614, via a communication link that carries signals and may be implemented using wire or cable, fiber optics, a phone line, a cellular phone link, a radio frequency link, and/or other communication channels. With such a communications interface, it is contemplated that the one or more processors 602 might receive information from a network, or might output information to the network in the course of performing the above-described method steps. Furthermore, method embodiments may execute solely upon the processors or may execute over a network such as the Internet, in conjunction with remote processors, that share a portion of the processing.

The term "non-transient computer readable medium" is used generally to refer to media such as main memory, secondary memory, removable storage, and storage devices, such as hard disks, flash memory, disk drive memory, CD-ROM, and other forms of persistent memory and shall not be construed to cover transitory subject matter, such as carrier waves or signals. Examples of computer code include machine code, such as produced by a compiler, and files containing higher level code that are executed by a computer using an interpreter. Computer readable media may also be computer code transmitted by a computer data signal embodied in a carrier wave and representing a sequence of instructions that are executable by a processor.

In this embodiment, the controller 228 has non-transitory computer readable media. The computer readable media has computer readable code for providing the heating, the cooling, and the continuous clamping pressure during the heating and cooling and any time in between.

The texture can be simple, as in lines, to complex, as in pores and wrinkles to mimic leather. The depth and level of texturing in different embodiments may vary from slight (a few mils), to heavy (hundreds of mils). The depth of texturing need not be continuous over the substrate but rather can be made to vary depending on the needs and shape of the final product.

In an example of the textured dye carrier 208, the textured dye carrier 208 is textured paper made from cellulose fibers, which are preferably natural fibers. In this example, the release properties of the paper surface are modified by silicone, or organosilane, organofluorine, long chain amide, polytetrafluoroethylene (PTFE), or other internal/surface additives, which will facilitate the release of the paper from thermoplastic substrates. Some thermoplastics, such as acrylics, have a greater propensity to adhere to the textured dye carrier than others do.

Figure 7:
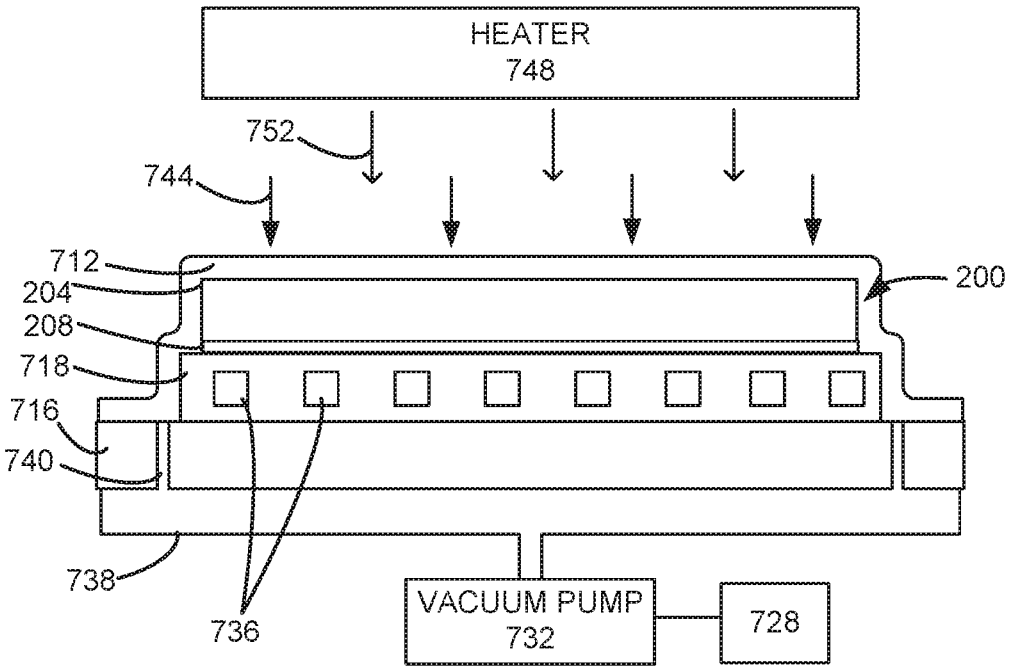
FIG. 7 is a schematic cross-sectional view of another embodiment.

FIG. 7 is a schematic cross-sectional view of a stack 200 in another embodiment of a press. The press comprises a platen 716 with a cooling plate 718. The stack 200 with the substrate 204 and the textured dye carrier 208 is placed on the cooling plate 718. A flexible airtight membrane 712, such as a silicone elastomeric membrane, is placed on a second side of the substrate 204, where the textured dye carrier 208 is placed on a first side of the substrate 204. The substrate 204 is between the textured dye carrier 208 and the flexible airtight membrane 712. A stack may be defined as the substrate 204 and plurality of process layers of the textured dye carrier 204 and the airtight membrane 714. A vacuum pump 732 provides a vacuum to a vacuum chamber 738. The vacuum chamber 738 draws air through evacuation channels 740, which draws air from between the flexible airtight membrane 712, the platen 716, the stack 200, and the cooling plate 718. The evacuation of the air between the flexible airtight membrane 712 and the stack 200 and the atmospheric pressure outside of the flexible airtight membrane 712 clamps the stack 200 (step 112) with a vacuum pressure and creates the continuous clamping pressure 744.

In this embodiment, a heater 748 provides heat 752 to heat the stack 200 to a temperature above the sublimation temperature of the stack (step 116). In this embodiment, the heat 752 passes through the flexible airtight membrane 712 to the stack 200. In this example, the stack 200 is heated to a temperature above 350° F. The stack 200 was maintained above the sublimation temperature for at least 10 minutes.

In this embodiment, the cooling of the stack 200 (step 120) is provided by the cooling plate 718. In this example, cooling elements 736 are used to cool the cooling plate 718. In other embodiments, passive cooling may be used to cool the stack 200. Such passive cooling would use radiant cooling instead of cooling elements 736 to cool the stack 200. The controller 728 is controllably connected to the vacuum pump 732, the heater 748, and the cooling elements 736.

The continuous pressure is removed (step 124) by allowing a flow of gas to remove the vacuum. The textured dye carrier 208 is removed from the substrate 204 (step 124) and the texture from the textured dye carrier 208 is transferred to the substrate 204 during the sublimation process.

The flexible airtight membrane 712 must have sufficient strength to prevent warping of the substrate. The flexible airtight membrane 712 material is preferably compatible with the dye and byproducts out-gassed from the substrate 204. Preferably, the flexible airtight membrane 712 is able to withstand several thermal cycles between higher and lower temperatures without hardening, cracking, or loss of structural integrity. Materials for forming the flexible airtight membrane 712 may be one or more of vulcanized rubbers, silicones, butyl rubbers, polymers, chloropolymers, or fluoropolymers.

Figure 8:
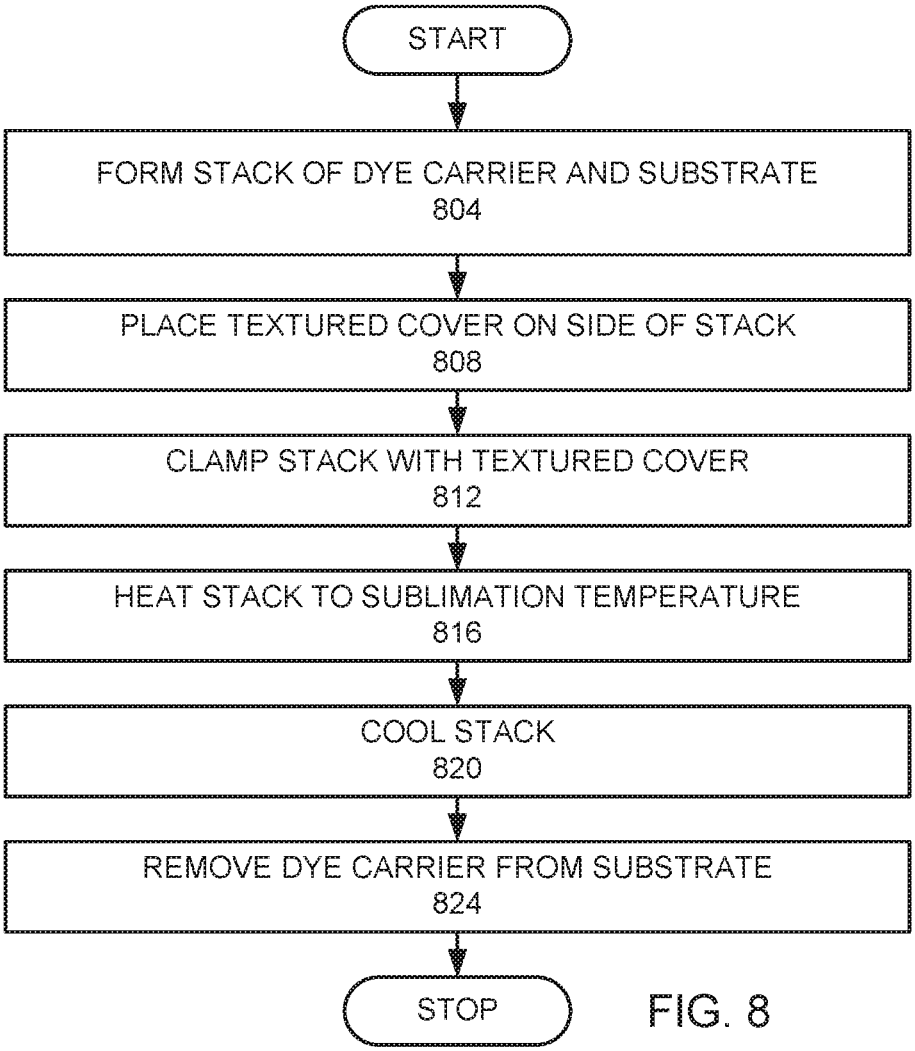
FIG. 8 is a high level flow chart of another embodiment.

In other embodiments, the texturing may be provided from another layer in a stack that is different from the dye carrier. To facilitate understanding of such embodiments, FIG. 8 is a high level flow chart of a process used in another embodiment. In this embodiment, a stack of a dye carrier and a substrate is formed (step 804). A textured cover is placed on a side of the stack (step 808). The stack and the textured cover are clamped together (step 812). The stack is heated to at least a sublimation temperature of the stack (step 816). In the specification and claims, the sublimation temperature of a stack is defined as the minimum temperature at which a solid dye on the dye carrier transitions from solid to gas phase, without passing through an intermediate liquid phase, and wherein the dye in gas phase penetrates into the substrate, where the dye creates an image in the substrate. The stack is cooled to a release temperature below the sublimation temperature (step 820). The dye carrier is removed from the substrate (step 824).

EXAMPLE

Figure 9A:
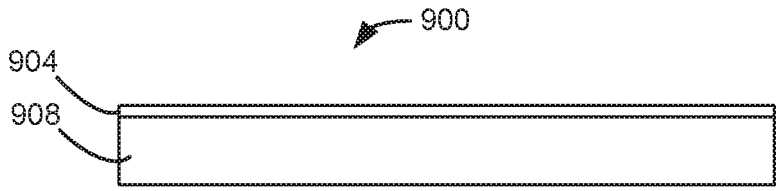
FIGS. 9A-C are schematic cross-sectional views of a stack used in an embodiment.
Figure 10:
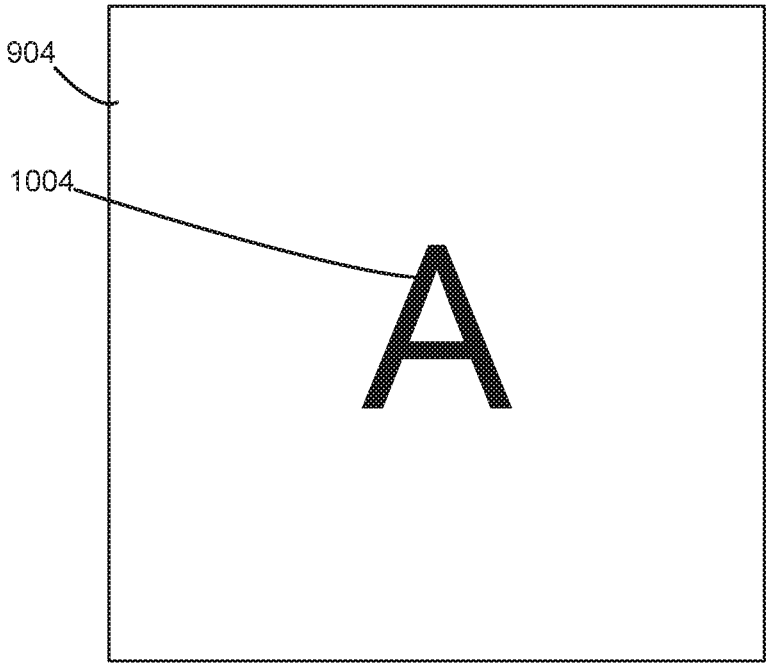
FIG. 10 is a schematic top view of a dye carrier used in an embodiment.

In an example of an embodiment, a stack of a dye carrier and a substrate is formed (step 804). FIG. 9A is a side view of a stack 900 comprising a dye carrier 904 and a substrate 908. FIG. 10 is a top view of the dye carrier 904. In this example, the dye carrier 904 is paper and the substrate 908 is a thermoplastic such as acrylonitrile butadiene styrene (ABS). The dye carrier 904 and the substrate 908 are not drawn to scale. Dye sublimation ink 1004 is on the dye carrier 904 creating a design.

Figure 9B:
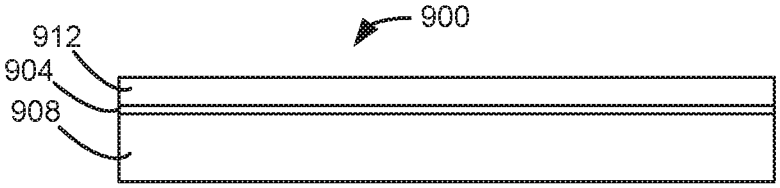
Figure 11:
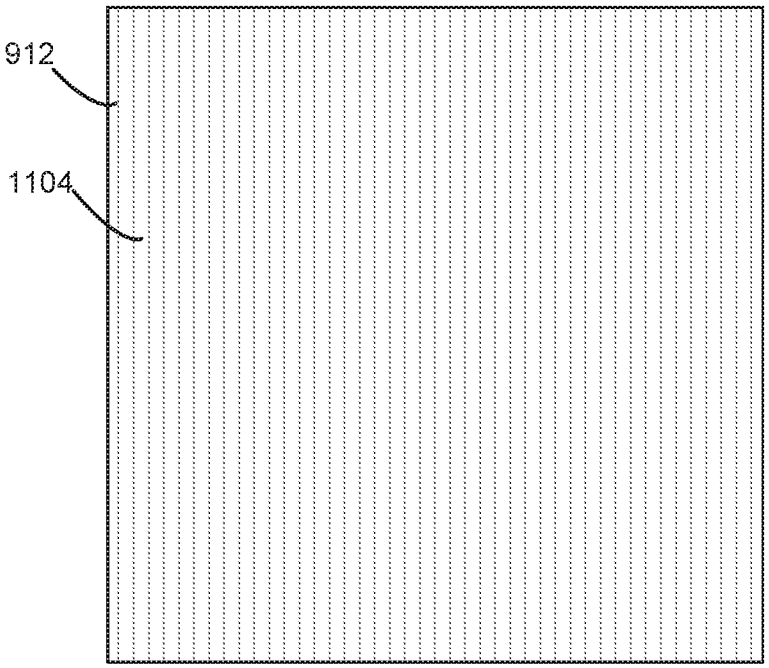
FIG. 11 is a schematic top view of a textured cover used in an embodiment.

A first side of a textured cover is placed on a side of the stack (step 808). FIG. 9B is a side view of a stack 900 with the textured cover 912 on a side of the stack 900. FIG. 11 is a top view of the first side of the textured cover 912 showing a texture of ridges 1104. In this embodiment, the first side of the textured cover 912 is placed on the dye carrier sheet 904, so that the dye carrier sheet 904 is between the textured cover 912 and the substrate 908. In this example, the textured cover 912 is a metallic sheet.

Figure 9C:
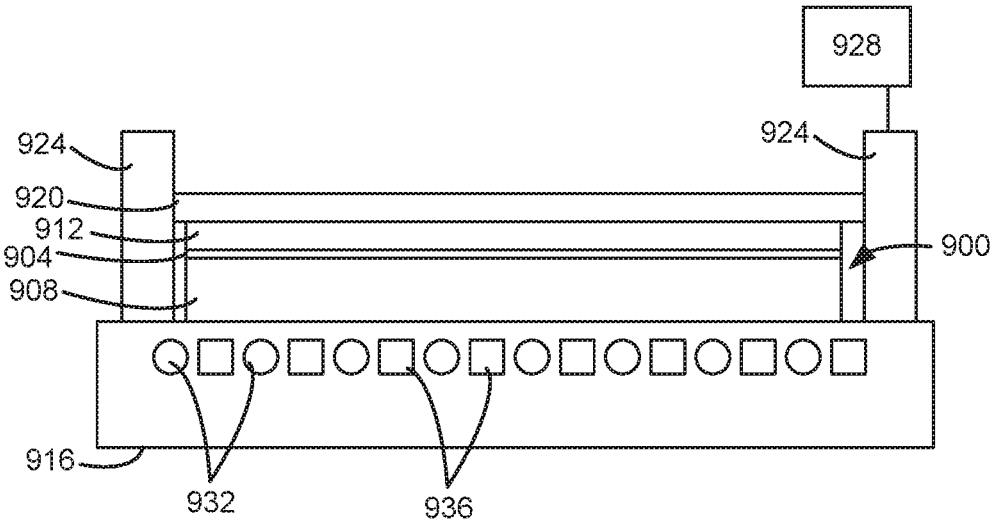

A continuous clamping pressure is provided to clamp the stack 900 and the textured cover 912 (step 812). FIG. 9C is a side view of the stack 900 and textured cover 912 being clamped by a platen 916 on the bottom and a top pressure plate 920 providing a continuous clamping pressure across the stack 900. In this example, a clamping drive 924 is connected between the top pressure plate 920 and the platen 916. The clamping drive 924 provides the continuous clamping force between the top pressure plate 920 and the platen 916. A controller 928 is controllably connected to the clamping drive 924. In this example, a pressure of at least 5 pounds per square inch is provided across the entire top surface of the stack 900. In various embodiments, even if pressure is applied uniformly, the geometry of the textured cover may cause pressure applied to the dye carrier and substrate to vary on a local level.

The stack 900 is heated to at least a sublimation temperature (step 816). In this embodiment, heating elements 932 in the platen 916 are used to heat the stack 900. In this example, the sublimation temperature, which sublimates the dye and causes the dye in gas phase to penetrate into the substrate 908 and create an image in the substrate 908, is a temperature above the glass transition temperature of the substrate 908. The glass transition temperature is a temperature for which the substrate transitions from a solid state to a viscous or rubbery state as temperature is increased. In this example, the stack is heated to a temperature of greater than 250° F. The stack is maintained at a temperature of greater than 350° F., while continuously clamped at a pressure of at least 5 pounds per square inch for at least 80 minutes.

The stack 900 is cooled to a release temperature below the sublimation temperature (step 816). In this embodiment, cooling elements 936 in the platen 916 are used to cool the stack 900. In this example, the stack 900 is cooled to a temperature below the glass transition temperature of the substrate 908. In this example, the stack is cooled to a release temperature of less than 250° F. The stack is maintained at a temperature of less 250° F., while continuously clamped at a pressure of at least 5 pounds per square inch for at least 5 minutes. In this example, at the release temperature, the substrate 908 is substantially rigid.

Figure 12:
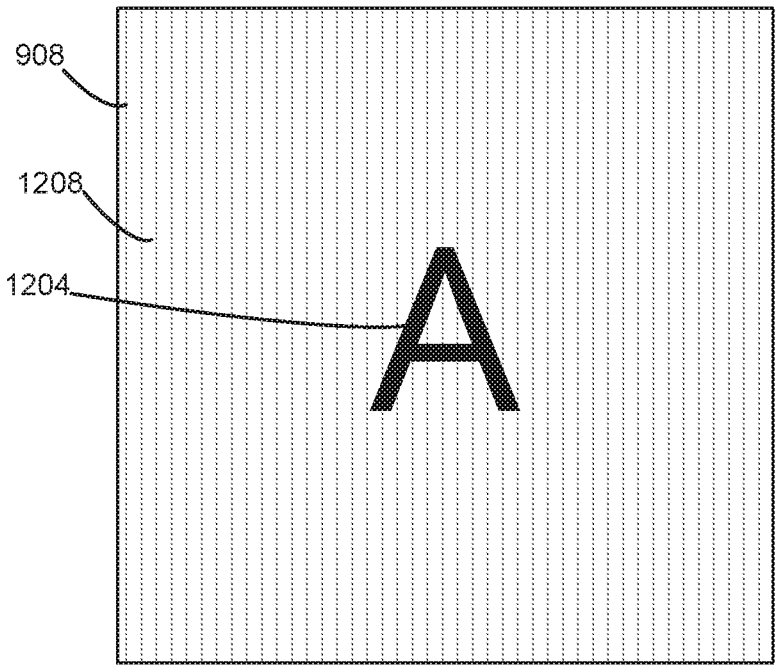
FIG. 12 is a schematic top view of a substrate processed in an embodiment

The dye carrier 904 is removed from the substrate 908 (step 824). In this example, the continuous clamping pressure is removed. The stack 900 and textured cover 912 are removed from the platen 916 and top pressure plate 920. The dye carrier 904 and the textured cover 912 are removed from the substrate 908. FIG. 12 is a top view of the substrate 908. An image 1204 has been sublimated into the substrate 908 from the dye carrier 904. The sublimated dye forms an image in the substrate 908 instead of on a surface of the substrate 908. Surface texturing 1208 has been transferred to the substrate 908 from the textured cover 912.

The texture can be simple, as in lines, to complex, as in pores and wrinkles to mimic leather. The depth and level of texturing in different embodiments may vary from slight (a few mils), to heavy (hundreds of mils). The depth of texturing need not be continuous over the substrate but rather can be made to vary depending on the needs and shape of the final product.

In an example of the dye carrier 904, the dye carrier is paper made from cellulose fibers, which are preferably natural fibers. In this example, the release properties of the paper surface are modified by silicone, or organosilane, organofluorine, long chain amide, polytetrafluoroethylene (PTFE), or other internal/surface additives, which will facilitate release of the paper from thermoplastic substrates. Some thermoplastics, such as acrylics, have a greater propensity to adhere to the transfer paper than others do.

Figure 13:
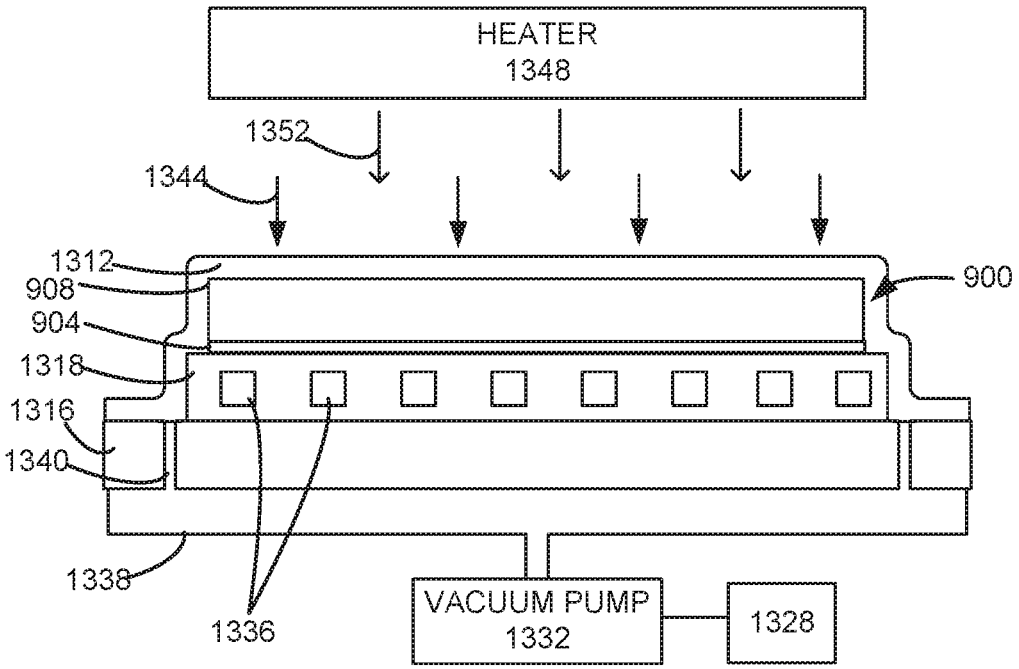
FIG. 13 is a schematic cross-sectional view of another embodiment.

FIG. 13 is a schematic cross-sectional view of a stack 900 in another embodiment of a press. The press comprises a platen 1316 with a cooling plate 1318. The stack 900 with the substrate 908 and dye carrier 904 is placed on the cooling plate 1318. In this embodiment, the textured cover 1312 is a flexible airtight membrane. In this example, the textured cover 1312 is a silicone membrane. In this embodiment, the textured cover 1312 is placed on a second side of the substrate 908, where the dye carrier 904 is placed on a first side of the substrate 908. The substrate 908 is between the dye carrier 904 and the textured cover 1312. A stack may be defined as the substrate 908 and plurality of process layers of the dye carrier 904 and the textured cover 1312, which is a flexible airtight membrane. A vacuum pump 1332 provides a vacuum to a vacuum chamber 1338. The vacuum chamber 1338 draws air through evacuation channels 1340, which draw air from between the textured cover 1312, the platen 1316, the stack 900, and the cooling plate 1318. The evacuation of the air between the textured cover 1312 and the stack 900 and the atmospheric pressure outside of the textured cover 1312 clamps the textured cover 1312 to the stack 900 (step 812) and creates the continuous clamping pressure 1344.

In this embodiment, a heater 1348 provides heat 1352 to heat the stack 900 to a temperature above the sublimation temperature of the stack (step 816). In this embodiment, the heat 1352 passes through the textured cover 1312 to the stack 900. In this example, the stack 900 is heated to a temperature above 350° F. The stack 900 was maintained above the sublimation temperature for at least 80 minutes.

In this embodiment, the cooling of the stack 900 (step 820) is provided by the cooling plate 1318. In this example, cooling elements 1336 are used to cool the cooling plate 1318. In other embodiments, passive cooling may be used to cool the stack 900. Such passive cooling would use radiant cooling instead of cooling elements 1336 to cool the stack 900. The controller 1328 is controllably connected to the vacuum pump 1332, the heater 1348, and the cooling elements 1336.

The continuous pressure is removed (step 824) by allowing a flow of gas to remove the vacuum. The dye carrier 904 is removed from the substrate 908 (step 824). It has been found that texture from a silicone membrane is transferred to the substrate 908 during the sublimation process.

If the textured cover is a membrane, which is also used to provide a vacuum based clamping, the membrane must have sufficient strength to prevent warping of the substrate. The membrane material is preferably compatible with the dye and byproducts out-gassed from the substrate. Preferably, the membrane is able to withstand several thermal cycles between higher and lower temperatures without hardening, cracking, or loss of structural integrity. Materials for forming the membrane may be one or more of vulcanized rubbers, silicones, butyl rubbers, polymers, chloropolymers, or fluoropolymers.

In various embodiments, the material forming the textured dye carrier 208 or textured cover 912 may be metal, rubber, plastic, wood, paper, fabric, fiberboard, cardboard, or a combination of these materials. To provide the textured dye carrier 208, a dye carrier sheet of metal, rubber, plastic, wood, paper, fabric, fiberboard, cardboard or a combination of these materials may be provided. The term "fabric" includes cloth and other textiles. The dye carrier sheet or textured cover are then textured. The texturing may be formed by an additive process, such as 3D printing or welding on the first side of the textured dye carrier 208 or textured cover 912. In other embodiments, a molding process may be used to form the textured dye carrier 208 or textured cover 912, such as using a dye carrier material or textured cover material that is a liquid and poured or injected into a mold and then hardened. The hardened material is removed from the mold and used to form elements of the textured dye carrier 208 or textured cover 912. In other embodiments, a subtractive process may be used to form the textured dye carrier 208 or textured cover by cutting or removing material from the textured dye carrier 208 or textured cover 912, using a laser cutting, water jet cutting, drilling, planing, milling, electrical discharge machining, electrochemical machining, electron beam machining, photochemical machining, or traditional machining. In other embodiments, the texturing may be provided by a deformation process, such as stamping, extrusion, pultrusion, rolling, forging, or die forming. In other embodiments, the texturing may be provided by weaving or knitting. Examples of a textured dye carrier 208 or textured cover 912 may be embossed paper or cardboard. Other examples of a textured dye carrier 208 or textured cover 912 may be textiles made from cotton or other cellulosic fibers, wool or other animal fibers, polyester, nylon, or polyurethane, or other synthetic fibers. In such embodiments, the texturing may be provided by a weaving process, a knitting process, an embroidery process, a stamping process, an abrasive process, or other processes typically used to provide texture to fabric. Before or after the texturing of the dye carrier sheet, an image using dye sublimation ink is formed on the dye carrier sheet.

In various embodiments, the substrate is a thermoplastic item. The thermoplastic item may be in the form of a flat sheet or curved sheet or a ball, or any other three dimensional or two dimensional shape. The thermoplastic may be one or more of ABS (Acrylonitrile Butadiene Styrene), PVC (Polyvinyl chloride), PVF (PolyVinyl Fluoride), PET (Polyethylene Terephthalate), PBT (Polybutylene terephthalate), polyesters, polycarbonates, acrylic alloys, thermoplastic Urethane, Lexan™ by GE, Valox™ by GE, Altuglas Solarkote™, Plexiglas™, Tedlar™ by Dupont, and Korad™ Polymer Extruded Products (Spartech).

Alternative embodiments utilize other means of attaining the very even clamping pressure. These alternatives include but are not necessarily limited to, the use of mechanical clamping pads incorporating a pressure-leveling layer, such as foam rubber or sacrificial rigid foam sheets, and the use of air pressure clamps, such as bag presses.

Alternative embodiments utilize various heat transfer methods. Such heat transfer methods may include electrical resistance heating, steam heating, flame heating, fluid heating, or radiant energy heating.

While the specifics of any given imaging regime are both highly specific and empirically determinable, in general terms, the embodiment contemplates imaging temperatures for most plastic substrates at temperatures between 200° F.-600° F. More particularly plastic substrates are heated to temperatures between 225° F. and 400° F. More particularly still plastic substrates are heated to temperatures between 250° F. and 370° F.

In various embodiments, the heating and cooling steps for imaging may be for periods between 15 seconds to 12 hours. More specifically, the heating and cooling steps for imaging may be for periods from 1 minute to 1 hour. More specifically, the heating and cooling steps for imaging may be for periods between 90 seconds to 15 minutes.

In various embodiments, the clamping pressure is from 0.25 atmospheres to 20 atmospheres. More particularly, the clamping pressures are from 0.5 to 5 atmospheres. More particularly, imaging pressures are from 0.7 to 1.5 atmospheres. The imaging pressures are satisfactory for a wide variety of plastic substrates.

The provision of a continuous pressure from the heating region to the cooling region may improve the sublimation process. Without being bound by theory, it is believed that, since the pressure is not removed as the stack passes from a heating step to a cooling step, the image quality is improved. The provision of the continuous pressure also facilitates the transfer of the texture from the textured dye carrier 208 or textured cover 912 to the substrate. It is further believed that the continuous pressure helps to keep the substrate from shrinking, enlarging, extruding, or warping in at least one direction and in possibly all directions. Shrinking, enlarging, extruding, and warping may also be limited by the lower temperature and lower pressure required by various embodiments.

Various embodiments for providing continuous pressure, heating, or cooling are described in U.S. Pat. No. 6,814,831, entitled "Method and apparatus for continuously forming dye sublimation images in solid substrates," issued on Nov. 9, 2004, which is incorporated by reference for all purposes and in U.S. Pat. No. 8,308,891, entitled "Method For Forming Dye Sublimation Images In Solid Substrates," issued Nov. 13, 2012, which is incorporated by reference for all purposes.

In various embodiments, the substrate 204 subsequently may be reheated to a temperature between 275° F. and 400° F. to allow the thermal forming of the substrate 204. The substrate 204 may be thermal formed where an elongation of more than 40% of a region of the substrate 204 may occur. An elongation of up to 60% would not cause the image at the region of elongation to thin appreciably (significantly reduce the intensity of the image).

While this disclosure has been described in terms of several preferred embodiments, there are alterations, permutations, modifications, and various substitute equivalents, which fall within the scope of this disclosure. It should also be noted that there are many alternative ways of implementing the methods and apparatuses of the present disclosure. It is therefore intended that the following appended claims be interpreted as including all such alterations, permutations, and various substitute equivalents as fall within the true spirit and scope of the present disclosure.

What is claimed is:

1. A method for texturing a thermoplastic substrate, while forming a dye sublimation image in the thermoplastic substrate, comprising:

forming a stack comprising a thermoplastic substrate and a plurality of processing layers, wherein the plurality of processing layers comprise a dye carrier having a dye image of dye sublimation ink formed thereon and an elastomeric membrane and wherein at least one of the processing layers of the stack is textured;

providing a vacuum pressure on the stack through the elastomeric membrane, wherein the stack is clamped together;

heating the stack to at least a sublimation temperature of the stack, which causes the dye sublimation ink to sublimate and penetrate through a side of the thermoplastic substrate, creating the dye sublimation image in the thermoplastic substrate and wherein texture from at least one of the process layers is transferred to the thermoplastic substrate;

cooling the thermoplastic substrate to a release temperature, which causes the thermoplastic substrate to be rigid;

removing the vacuum pressure after the thermoplastic substrate is cooled to the release temperature; and removing the thermoplastic substrate from the stack.

2. The method, as recited in claim 1, further comprising thermoforming the thermoplastic substrate.

3. The method, as recited in claim 1, wherein the heating the stack to the sublimation temperature of the stack heats the stack to a temperature greater than a glass transition temperature of the thermoplastic substrate.

4. The method, as recited in claim 1, wherein the dye carrier is a textured dye carrier and further comprising forming the textured dye carrier, comprising:

providing a dye carrier sheet;

forming texture on at least one side of the dye carrier sheet; and forming an image on the dye carrier sheet.

5. The method, as recited in claim 4, wherein the forming texture on the at least one side of the dye carrier sheet comprises using at least one of an additive process, a molding process, a deformation process, or a subtractive process.

6. The method, as recited in claim 4, wherein the forming the texture on the side of the dye carrier sheet comprises using a subtractive process on the side of the dye carrier sheet comprising at least one of laser cutting, water jet cutting, drilling, planing, milling, electrical discharge machining, electrochemical machining, electron beam machining, photochemical machining, or traditional machining the side of the dye carrier sheet.

7. The method, as recited in claim 4, wherein the forming the texture on the side of the dye carrier sheet comprises performing an additive process on the side of the dye carrier sheet, comprising at least one of 3D printing or welding on the side of the textured dye carrier.

8. The method, as recited in claim 4, wherein the forming texture on the at least one side of the dye carrier sheet comprises performing a deformation process on the dye carrier sheet, wherein the deformation process comprises at least one of stamping, extrusion, pultrusion, rolling, forging, or die forming.

9. The method, as recited in claim 4, wherein the forming of the texture on the side of the dye carrier sheet comprises constructing the dye carrier sheet using a weaving process.

10. The method, as recited in claim 4, wherein the forming of the texture on the side of the dye carrier sheet comprises constructing the dye carrier sheet using a knitting process.

11. The method, as recited in claim 4, wherein the textured dye carrier is of at least one of paper, plastic, rubber, wood, fabric, fiberboard, cardboard, or metal.

12. The method, as recited in claim 1, wherein the providing the vacuum pressure provides a clamping pressure across the stack.

13. The method, as recited in claim 1, wherein the vacuum pressure is at least 5 pounds per square inch.

14. The method, as recited in claim 1, wherein the release temperature is a temperature which causes the thermoplastic substrate to be rigid.

15. The method, as recited in claim 14, further comprising removing the dye carrier from the thermoplastic substrate.

16. A method for texturing a thermoplastic substrate, while forming a dye sublimation image in the thermoplastic substrate, comprising:

placing a textured dye carrier having an image formed thereon of a dye sublimation ink on a side of the thermoplastic substrate to form a stack;

providing a clamping pressure on the stack, wherein the stack is clamped together; and heating the stack to at least a sublimation temperature of the stack, which causes the dye sublimation ink to sublimate and penetrate through the side of the thermoplastic substrate, creating the dye sublimation image in the thermoplastic substrate and wherein texture from the textured dye carrier is transferred to the thermoplastic substrate;

cooling the thermoplastic substrate to a release temperature, which causes the thermoplastic substrate to be rigid;

removing the clamping pressure after the thermoplastic substrate is cooled to the release temperature; and removing the thermoplastic substrate from the stack.

17. The method, as recited in claim 16, further comprising thermoforming the thermoplastic substrate.

18. The method, as recited in claim 16, wherein the sublimation temperature of the stack is greater than a glass transition temperature of the thermoplastic substrate.

19. The method, as recited in claim 16, further comprising forming the textured dye carrier, comprising:

providing a dye carrier sheet;

forming texture on at least one side of the dye carrier sheet; and forming the image on the dye carrier sheet.

20. The method, as recited in claim 16, wherein the providing the clamping pressure comprises providing a vacuum pressure through an elastomeric membrane.

* * * * *